US009896904B2

(12) United States Patent
Ringgenberg

(10) Patent No.: US 9,896,904 B2
(45) Date of Patent: Feb. 20, 2018

(54) RUPTURE DISC SECONDARY SEAL ASSEMBLY AND RELATED METHODS

(71) Applicant: Halliburton Energy Services, Inc., Houston, TX (US)

(72) Inventor: Paul David Ringgenberg, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 369 days.

(21) Appl. No.: 14/438,550

(22) PCT Filed: Dec. 6, 2012

(86) PCT No.: PCT/US2012/068215

§ 371 (c)(1),
(2) Date: Apr. 24, 2015

(87) PCT Pub. No.: WO2014/088579

PCT Pub. Date: Jun. 12, 2014

(65) Prior Publication Data

US 2015/0275621 A1 Oct. 1, 2015

(51) Int. Cl.
*E21B 34/06* (2006.01)

(52) U.S. Cl.
CPC ..... *E21B 34/063* (2013.01)

(58) Field of Classification Search
None
See application file for complete search history.

(56) References Cited

U.S. PATENT DOCUMENTS

| | | | | |
|---|---|---|---|---|
| 3,240,357 | A * | 3/1966 | Bowyer | B25J 3/00 403/50 |
| 5,890,616 | A * | 4/1999 | Cravens | B65D 25/16 220/23.86 |
| 6,752,212 | B2 | 6/2004 | Burris et al. | |
| 7,950,409 | B2 | 5/2011 | Stokes et al. | |
| 2003/0010503 | A1 | 1/2003 | Staudt | |
| 2003/0079821 | A1* | 5/2003 | Meguro | B32B 15/06 156/94 |
| 2010/0251978 | A1* | 10/2010 | Amano | F01P 11/06 123/41.01 |
| 2010/0255760 | A1* | 10/2010 | Marshall, Jr. | B24B 1/04 451/41 |
| 2011/0180539 | A1* | 7/2011 | Payne | B60K 15/0409 220/315 |

FOREIGN PATENT DOCUMENTS

| | | |
|---|---|---|
| EP | 0442199 A2 | 11/1990 |
| WO | WO 00/55539 A1 | 9/2000 |

OTHER PUBLICATIONS

International Search Report and The Written Opinion of the International Searching Authority, or the Declaration, dated Jul. 26, 2013, PCT/US2012/068215, 14 pages, ISA/KR.

* cited by examiner

*Primary Examiner* — Shane Bomar

(57) ABSTRACT

A rupture disc assembly having a secondary seal positioned over the coupling area between the rupture disc and the tool housing. The secondary seal may be, for example, sealing tape, an o-ring, liquid sealant, metallic sealing tape, etc., or a combination of two or more of these elements.

20 Claims, 3 Drawing Sheets

RUPTURE DISC SECONDARY SEAL ASSEMBLY AND RELATED METHODS

The present application is a U.S. National Stage patent application of International Patent Application No. PCT/US2012/068215, filed on Dec. 6, 2012, the benefit of which is claimed and the disclosure of which is incorporated herein by reference in its entirety.

FIELD OF THE INVENTION

The present invention relates generally to rupture discs and, more specifically, to a rupture disc secondary seal system that increases tool reliability.

BACKGROUND

Rupture discs have been utilized in downhole tools for some time. For example, a rupture disc may function as a safety valve when the annulus pressure reaches a predetermined value. At that pressure, the rupture disc will burst, thus causing the valve to isolate the workstring below the tool, establish communication between the annulus and the workstring above the tool, or some other desired function.

There are, however, disadvantages to conventional rupture disc designs. If the seal between the rupture disc and temporary air chamber coupled to the rupture disc is damaged, pressure may leak around the rupture disc and cause the tool to work improperly. Also, since conventional rupture discs are threaded into the tool housing using 1-1.5 threads, the rupture disc may loosen and back out of the housing before hydrostatic pressure is supplied. As a result, a gap is created between the bottom of the rupture disc and the tool housing which may also cause pressure leakage around the rupture disc.

In view of the foregoing, there is a need in the art for a rupture disc having a secondary sealing device, thus providing a more reliable rupture disc system.

DESCRIPTION OF ILLUSTRATIVE EMBODIMENTS

Illustrative embodiments and related methodologies of the present invention are described below as they might be employed in a rupture disc secondary seal assembly. In the interest of clarity, not all features of an actual implementation or methodology are described in this specification. Also, the "exemplary" embodiments described herein refer to examples of the present invention. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

Figure 1:
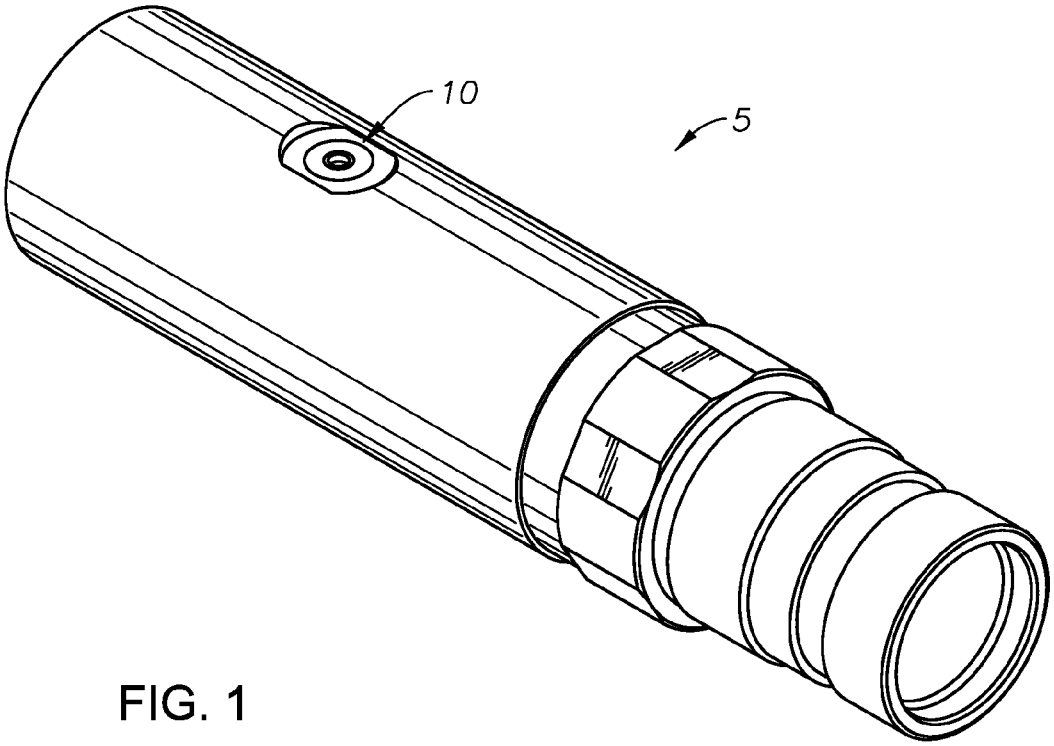
FIG. 1 is an isometric illustration of a downhole tool comprising a rupture disc secondary seal assembly according to certain exemplary embodiments of the present invention.

FIG. 1 illustrates an exemplary embodiment of a rupture disc secondary seal assembly 10 positioned along a downhole tool 5 according to certain exemplary embodiments of the present invention. Downhole tool 5 may be any variety of downhole hole tools, such as, for example, a Rupture Disc ("RD") Safety Circulating Valve, RD Circulating Valve, Pump Through RD Safety Circulating Valve, Pump Through RD Safety Valve, ARMADA Sampler, Ful-Flo Sampler, ProPhase Electronic Tester/Circulating Valve, Below Packer Hydraulic Safety Joint, Multi-Purpose Tubing String Testing Valve, RD Tubing String Testing Valve, RD Pressure Test/Bypass Valve, Multi Service Valve, Surge Valve. As described herein, rupture disc secondary seal assembly 10 comprises a rupture disc having a primary and secondary seal. The secondary seal may take a variety of forms as described below including, for example, sealing tapes, liquid sealants, elastomeric seals and/or combinations of the same. Accordingly, a secondary seal is provided.

Figure 2C:
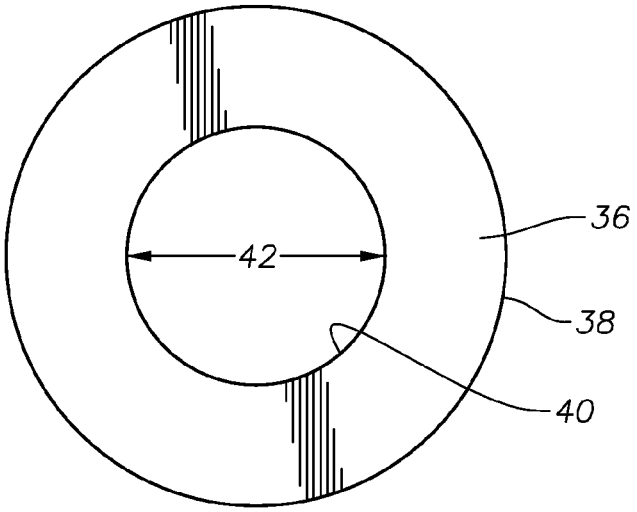
FIG. 2C illustrates a sealing tape according to certain exemplary embodiments of the present invention.
Figure 2A:
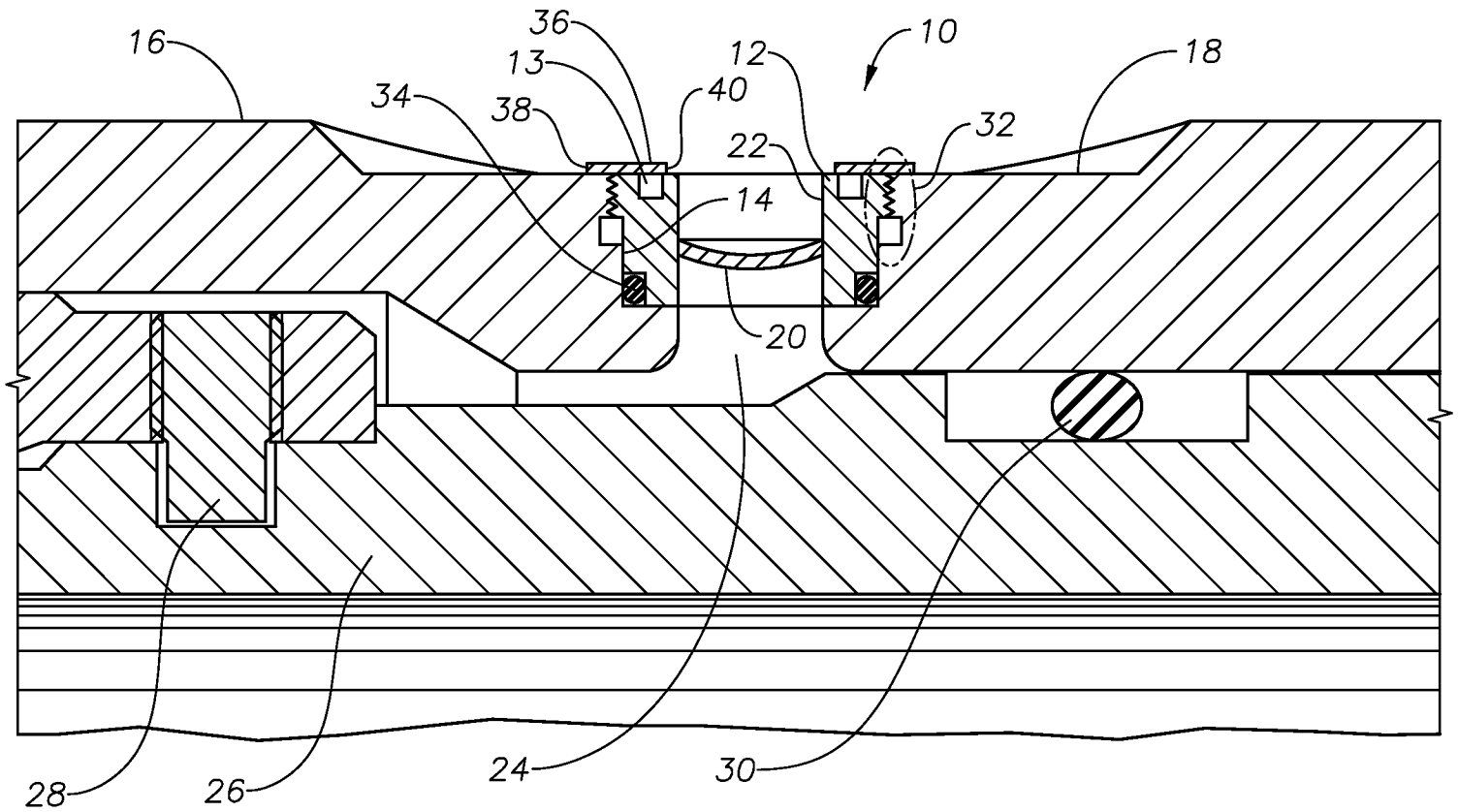
FIGS. 2A, 2B and 2D are cross-sectional views of a downhole tool comprising rupture disc secondary seal assembly according to certain alternate exemplary embodiments of the present invention.

FIG. 2A illustrates an exemplary embodiment of rupture disc secondary seal assembly 10 according to certain exemplary embodiments of the present invention. Here, rupture disc secondary seal assembly 10 includes a rupture disc housing 12 which has been coupled inside a bore 14 of downhole tool body 16. As understood in the art, the surface 18 of downhole tool body 16 is a rounded flat surface utilized to pressure test rupture disc secondary seal assembly 10. Also, as understood in the art, rupture disc secondary seal assembly 10 includes pin holes 13 which allow a tool (golf spike wrench, for example) to insert rupture disc housing 12 into bore 14. A rupture disc 20 is positioned along the bore 22 of rupture disc secondary seal assembly 10, which communicates with a temporary air chamber 24.

As will be understood by those ordinarily skilled in the art having the benefit of this disclosure, temporary air chamber 24 is positioned between rupture disc secondary seal assembly 10 and a mandrel 26 which, in turn, allows movement of mandrel 26 once rupture disc secondary seal assembly 10 has been ruptured. A shear screw 28 is also shown coupled between mandrel 26 and downhole tool body 16 above rupture disc secondary seal assembly 10. A seal 30 is positioned between downhole tool body 16 and mandrel 26 below temporary air chamber 24. The exact design of downhole tool 5 is illustrated here for exemplary purposes only, as those ordinarily skilled in the art having the benefit of this disclosure realize that rupture disc secondary seal assembly 10 may be utilized in any variety of tools.

Still referring to FIG. 2A, rupture disc housing 12 has been coupled to downhole tool 5 at coupling area 32. In other words, coupling area 32 is an area along downhole tool 5 where rupture disc housing 12 and downhole tool body 16 join. In this exemplary embodiment, the outer diameter of rupture disc housing 12 includes threads which mate which threads along the inner diameter of downhole tool body 16. However, those ordinarily skilled in the art having the benefit of this disclosure realize that other coupling methods may be utilized, such as, for example, the rupture disc may be held by a Smalley® snap ring/retainer ring in combination with a spring. At the lower end of coupling area 32 is a seal 34, also known as the primary seal, positioned around the outer diameter of rupture disc housing 12. As understood in the art, seal 34 protects against pressure leakage between rupture disc housing 12 and downhole tool body 16.

In order to provide a secondary seal for rupture disc secondary seal assembly 10, certain exemplary embodiments of the present invention utilize sealing tape 36 as a secondary seal positioned over coupling area 32. Sealing tape 36 may be, for example, Teflon® tape or Nylon® reinforced tape, as will be understood by those ordinarily skilled in the art having the benefit of this disclosure. Nevertheless, sealing tape 36 is positioned over coupling area 32 such that its straddles the surface of downhole tool 5 on one end 38 and the surface of rupture disc housing 12 on the other end 40. Sealing tape 36 comprises a suitable adhesive on its inner surface to ensure it adheres sufficiently. In this embodiment, sealing tape 36 is a washer-shaped piece of tape, having an opening 42 to expose bore 22 of rupture disc housing 12, as shown in FIG. 2C. As pressure is applied to rupture disc secondary seal assembly 10, a portion of sealing tape 36 is forced down into coupling area 32, thus providing a secondary seal.

In certain alternative exemplary embodiments, sealing tape 36 may also be a solid disc shaped piece of tape that extends over bore 22. In another embodiment, sealing tape 36 may also be transparent so that the rupture rating of rupture disc 20 could be visible. In addition, in embodiments utilizing a solid disc shaped sealing tape 36, the transparent tape would allow visual confirmation of whether rupture disc 20 has been ruptured.

Figure 2B:
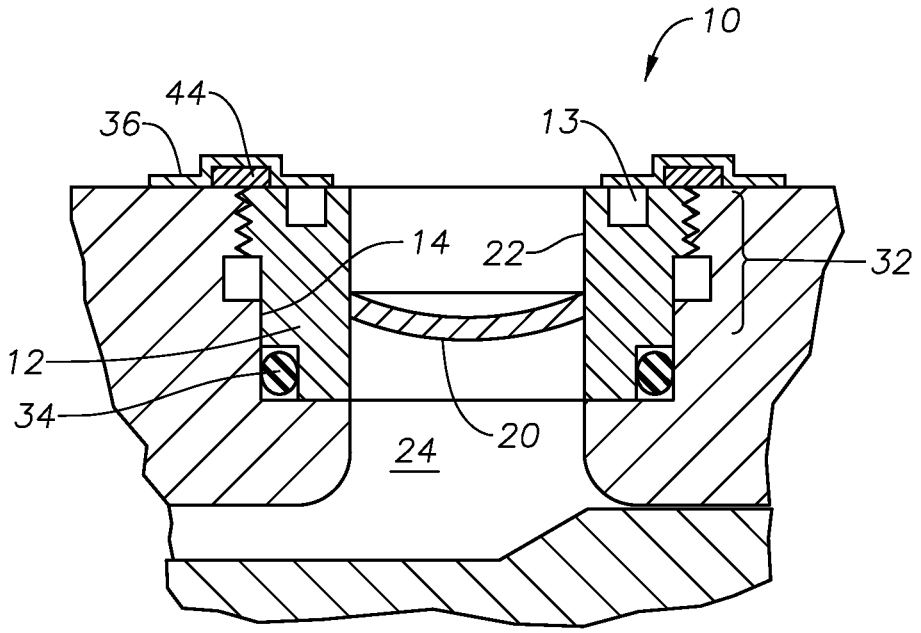

FIG. 2B illustrates yet another exemplary embodiment of the present invention. This embodiment is identical to that of FIG. 2A, except that a seal 44 is positioned between sealing tape 36 and coupling area 32. Seal 44 may be, for example, an elastomeric component or o-ring. Once sealing tape 36 is place atop seal 44, it will hold it in place and protect it from the downhole environment. In an alternative embodiment, a suitable adhesive may be applied to the inner surface of seal 44 to adhere it to coupling area 32. As hydrostatic pressure is applied to rupture disc secondary seal assembly 10, seal 44 is forced down into coupling area 32, thus effectively sealing coupling area 32. Accordingly, a secondary seal is provided.

In yet another exemplary embodiment, rupture disc secondary seal assembly 10 comprises a liquid sealant applied on coupling area 32. The liquid sealant may be, for example, a Teflon-based compound, as will be understood by those ordinarily skilled in the art having the benefit of this disclosure. For example, in the embodiment shown in FIG. 2A, this exemplary embodiment would include applying a liquid sealant between sealing tape 36 and the top of coupling area 32. In the embodiment of FIG. 2B, for example, the liquid sealant may be applied between seal 44 and the top of coupling area 32. Sealing tape 36 will protect liquid sealant from the downhole environment. In other embodiments, the liquid sealant may also be applied down along the threads of coupling area 32 in FIG. 2A. In operation, as pressure is applied to rupture disc secondary seal assembly 10, sealing tape 36 and liquid sealant is at least partially forced down into coupling area 32, thus providing a second seal for rupture disc secondary seal assembly 10.

In yet another exemplary embodiment, sealing tape 36 may be comprises of an elastomeric material with adhesive on one side. As would be understood by those ordinarily skilled in the art having the benefit of this disclosure, the adhesive used in this embodiment and others described herein, will be selected to withstand the downhole environment. In yet another exemplary embodiment, sealing tape 36 may also be made of a metallic foil material. Such metallic foil materials may include, for example, aluminum foil, copper foil, stainless steel foil or a corrosion-resistive such as, for example, Inconel.

Figure 2D:
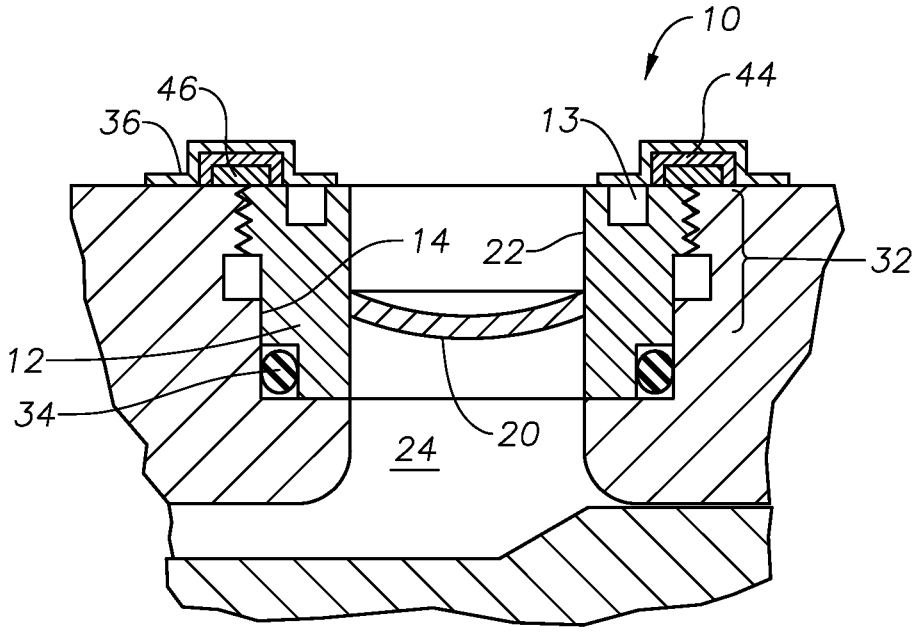

FIG. 2D illustrates yet another exemplary embodiment of the present invention. Here, rupture disc secondary seal assembly 10 is identical to the embodiment illustrated in FIG. 2B, except that a metallic washer 46 is positioned between seal 44 and the surface above coupling area 32. In some applications, seals 44 may extrude into the threaded connection along those coupling areas 32 which utilized threads. In this case, metallic washer 46 may be placed across coupling area 32. In operations, once pressure is applied to rupture disc secondary seal assembly 10, metallic washer 46 will partially mold down into coupling area 32 while seal 44 (elastomeric, for example) will seal around the outer edges of metallic washer 46. Accordingly, a secondary seal is provided.

The exemplary secondary seals of the embodiments of rupture disc secondary seal assembly 10 may be applied to a downhole tool in a variety of ways. For example, sealing tape 36 may be placed on the handle portion of a golf spike wrench. The handle of the tool may then be placed over bore 22 of housing 12. As a result, sealing tape 36 will be easily and properly aligned over coupling area 32. In the alternative, however, the exemplary secondary seals described herein may be applied by hand. In addition, certain exemplary embodiments of the exemplary secondary seals described herein are rated to withstand pressures of 32,000 psi or higher.

Accordingly, exemplary embodiments of the present invention provide a number of advantages. For example, the present invention provide a secondary seal for the rupture disc and provides protection to the primary seal since the secondary seal keeps it isolated from external fluids. In addition, embodiments of the present invention utilizing a transparent sealing tape provide a tamper proof indication that the rupture disc is still tightly coupled to the body of the tool. In addition, by extruding into the coupling area, the present invention provides an indication that the primary seal has failed. Moreover, in embodiments utilizing metallic foil sealing tape and the elastomeric seal, the present invention will provide a secondary and tertiary seal for the rupture disc. Accordingly, through utilization of multiple seals along rupture disc secondary seal assembly, a highly reliable rupture disc is provided because, should one seal fail, there are one or more backup seals to ensure the disc will seal properly.

An exemplary embodiment of the present invention provides a rupture disc assembly utilized in a downhole tool, the rupture disc assembly comprising a rupture disc housing comprising a bore therethrough, the rupture disc housing being coupled along a body of the downhole tool at a coupling area, a rupture disc positioned along the bore of the rupture disc housing, and a secondary seal positioned over the coupling area between the rupture disc housing and the body of the downhole tool. In another embodiment, the coupling area is a threaded profile formed by mating threads on an outer diameter of the rupture disc housing and an inner diameter of the body of the downhole tool. In yet another, the secondary seal is sealing tape. In another, the secondary seal is a washer-shaped piece of sealing tape. In yet another, the secondary seal is transparent sealing tape.

Another exemplary embodiment of the present invention further comprises an elastomeric seal positioned between the sealing tape and the coupling area. Yet another further comprises a metallic washer positioned between the elastomeric seal and the coupling area. Another further comprises a liquid sealant applied between the sealing tape and the coupling area. In yet another, the secondary seal is elastomeric sealing tape or a sealing tape comprising metallic foil material.

An exemplary methodology of the present invention provides a method of utilizing a rupture disc assembly in a downhole environment, the method comprising coupling a rupture disc along a body of a downhole tool at a coupling area, the rupture disc comprising a housing comprising a bore therethrough and a rupture disc positioned along the bore of the housing. The method goes on to comprise applying a secondary seal over the coupling area between the housing and the body of the downhole tool. In another method, coupling the rupture disc along the body of the downhole tool further comprises providing the coupling area as a threaded profile formed by mating threads on an outer diameter of the housing and an inner diameter of the body of the downhole tool. In yet another, applying the secondary seal further comprises providing the secondary seal as sealing tape. In another, applying the secondary seal further comprises providing the secondary seal as a washer-shaped piece of sealing tape.

In another method, applying the secondary seal further comprises providing the secondary seal as transparent sealing tape. Yet another methodology comprises positioning an elastomeric seal between the sealing tape and the coupling area. Another further comprises positioning a metallic washer between the elastomeric seal and the coupling area. Yet another further comprises applying a liquid sealant between the elastomeric seal and the coupling area. In another, applying the secondary seal further comprises providing the secondary seal as an elastomeric sealing tape. In yet another, applying the secondary seal further comprises providing the secondary seal as a metallic foil sealing tape.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the invention is not limited to such embodiments and methodologies and will be understood to include all modifications and variations as would be apparent to one skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A downhole tool assembly comprising:

a tool body having flat portion formed along an outer surface of the tool body, with an axial through bore extending from the flat portion of the outer surface;

a rupture disc housing disposed within the axial through bore, the rupture disk housing having a bore therethrough, the rupture disc housing disposed within the tool body through bore so as to form a joint between the tool body and the rupture disk housing adjacent the flat portion;

a rupture disc positioned along the bore of the rupture disc housing;

an elastomeric primary seal positioned between the rupture disk housing and the tool body at a location along the length of the rupture disk housing; and a secondary seal positioned on the flat portion of the tool body outer surface and extending over the joint formed between the rupture disc housing and the body of the downhole tool.

2. An assembly as defined in claim 1, wherein the rupture disk housing is coupled within the through bore of the tool body by a threaded profile formed by mating threads on an outer diameter of the rupture disc housing and an inner diameter of the tool body through bore of the downhole tool.

3. An assembly as defined in claim 1, wherein the secondary seal is sealing tape.

4. An assembly as defined in claim 3, wherein the secondary seal is sealing tape having a washer shape.

5. An assembly as defined in claim 1, wherein the secondary seal is transparent sealing tape.

6. An assembly as defined in claim 3, further comprising an elastomeric component positioned over the joint between the sealing tape and the joint.

7. An assembly as defined in claim 6, further comprising a metallic washer positioned over the joint between the elastomeric component and the joint.

8. An assembly as defined in claim 3, wherein the sealing tape is disposed over the entire joint and further includes an aperture formed in the sealing tape, the sealing tape disposed so that the aperture is positioned over the bore of the rupture disk housing.

9. An assembly as defined in claim 1, wherein the secondary seal is elastomeric sealing tape.

10. An assembly as defined in claim 1, wherein the flat portion forms a relief in the surface of the tool body.

11. A downhole tool assembly comprising:

a tool body having flat portion formed along an outer surface of the tool body, with an axial through bore extending from the flat portion of the outer surface;

a rupture disc housing disposed within the axial through bore, the rupture disk housing having a bore therethrough, the rupture disc housing disposed within the tool body through bore so as to form a joint between the tool body and the rupture disk housing adjacent the flat portion;

a rupture disc positioned along the bore of the rupture disc housing;

a primary seal positioned between the rupture disk housing and the tool body at a location along the length of the rupture disk housing, the primary seal comprising a first, elastomeric material; and a secondary seal positioned on the flat portion of the tool body outer surface and extending over the joint formed between the rupture disc housing and the tool body, the secondary seal comprising a second, non-elastomeric material.

12. The assembly of claim 11, wherein the secondary seal is a transparent seal disposed over the entire joint and over the bore of the rupture disk housing so as to allow the rupture disk to be visible through the secondary seal.

13. The assembly of claim 12, wherein the secondary seal is transparent sealing tape.

14. The assembly of claim 12, wherein the secondary seal is sealing tape with a transparent portion.

15. The assembly of claim 11, wherein the flat portion forms a relief in the outer surface of the tool body.

16. The assembly of claim 1, wherein the rupture disc housing has a distal end and a proximal end and is seated in the through bore of the tool body so that the proximal end is substantially coplanar with the flat portion of the tool body surface, wherein the primary seal is positioned along the rupture disk housing at the distal end thereof and the secondary seal overlays the proximal end of the rupture disk housing.

17. The assembly of claim 11, wherein the rupture disc housing has a distal end and a proximal end and is seated in the through bore of the tool body so that the proximal end is substantially coplanar with the flat portion of the tool body surface, wherein the primary seal is positioned along the rupture disk housing at the distal end thereof and the secondary seal overlays the proximal end of the rupture disk housing.

18. The assembly of claim 1, wherein the rupture disk housing further includes at least one engagement tool opening at a proximal end of the rupture disk housing adjacent the bore of the rupture disk housing, wherein the secondary seal overlays the joint and the at least one engagement tool opening.

19. The assembly of claim 11, wherein the rupture disk housing further includes at least one engagement tool opening at a proximal end of the rupture disk housing adjacent the bore of the rupture disk housing, wherein the secondary seal overlays the joint and the at least one engagement tool opening.

20. The assembly of claim 1, wherein the primary seal is formed of a first material and the secondary seal is formed of a second material different than the first material, the first material being an elastomer.

* * * * *